US008540799B2

(12) United States Patent
Mueller et al.

(10) Patent No.: US 8,540,799 B2
(45) Date of Patent: Sep. 24, 2013

(54) METHOD AND DEVICE FOR DEGASSING THE TRANSPORT CHAMBER OF A METERING PUMP

(75) Inventors: Klaus Mueller, Karlsruhe (DE); Sergej Gerz, Pfinztal (DE)

(73) Assignee: Grundfos Management a/s, Bjerringbro (DK)

( * ) Notice: Subject to any disclaimer, the term of this patent is extended or adjusted under 35 U.S.C. 154(b) by 211 days.

(21) Appl. No.: 13/139,527

(22) PCT Filed: Dec. 11, 2009

(86) PCT No.: PCT/EP2009/008876

§ 371 (c)(1),
(2), (4) Date: Jun. 14, 2011

(87) PCT Pub. No.: WO2010/072340

PCT Pub. Date: Jul. 1, 2010

(65) Prior Publication Data

US 2011/0247490 A1 Oct. 13, 2011

(30) Foreign Application Priority Data

Dec. 15, 2008 (DE) ..... 10 2008 061 904

(51) Int. Cl.
*B01D 19/00* (2006.01)

(52) U.S. Cl.
USPC ..... 95/26; 95/241; 95/30; 96/155; 96/175

(58) Field of Classification Search
USPC ..... 95/241, 30, 26; 96/155, 175
See application file for complete search history.

(56) References Cited

U.S. PATENT DOCUMENTS

| | | | |
|---|---|---|---|
| 3,238,891 | A | 3/1966 | Thier |
| 4,990,066 | A | 2/1991 | Kern |
| 5,871,566 | A | 2/1999 | Rutz |

FOREIGN PATENT DOCUMENTS

| | | | | |
|---|---|---|---|---|
| DE | 3827489 | C1 | | 10/1989 |
| JP | 05293306 | A | * | 11/1993 |
| JP | 10-115621 | A | | 5/1998 |
| JP | 2008-286587 | A | | 11/2008 |

OTHER PUBLICATIONS

Int'l Search Report issued Mar. 30, 2010 in Int'l Application No. PCT/EP2009/008876.

* cited by examiner

*Primary Examiner* — Duane Smith
*Assistant Examiner* — Douglas Theisen
(74) *Attorney, Agent, or Firm* — Panitch Schwarze Belisario & Nadel LLP

(57) ABSTRACT

A method is provided for degassing a transport chamber (1) of a metering pump. The method is based on performing impulse generation, wherein gas bubbles arising from the gas-forming fluid and adhering to the inner surfaces in the transport chamber (1) are released from the surfaces, wherein the gas bubbles (4.4', 8.8') present in the transport chamber (1) accumulate, perform a motion (c) in the direction of the pressure valve (6), and form an accumulated gas bubble (7) on the transport chamber side of the pressure valve (6). An increase in pressure causes the accumulated gas bubble present at the pressure valve (6) to escape from the transport chamber (1) as discharged gas bubbles (7') into the pressure line. A metering pump having a device present in the transport chamber for performing the impulse generation is also provided.

20 Claims, 6 Drawing Sheets

Fig.1.1
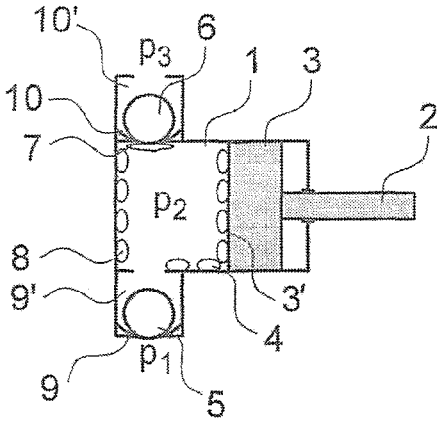
Fig.1.2
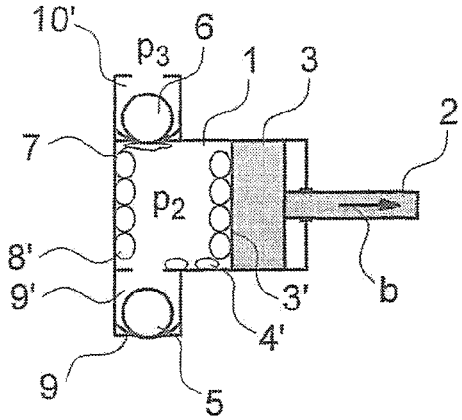
Fig.1.3
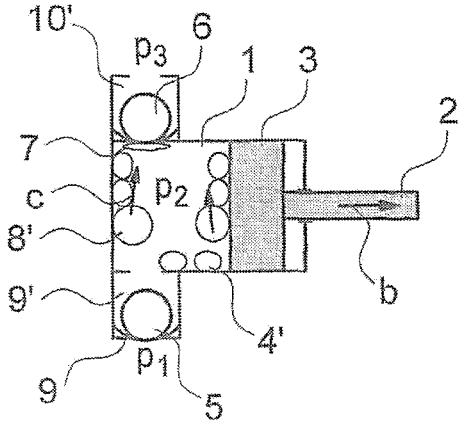
Fig.1.4
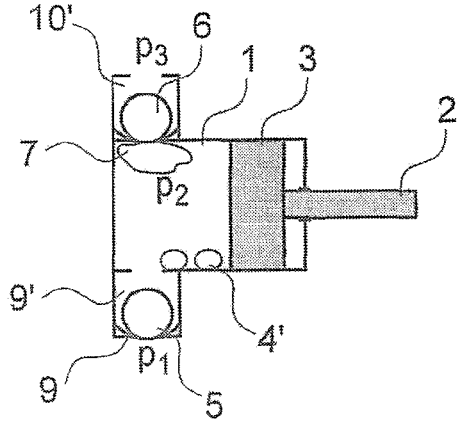

Fig.1.5
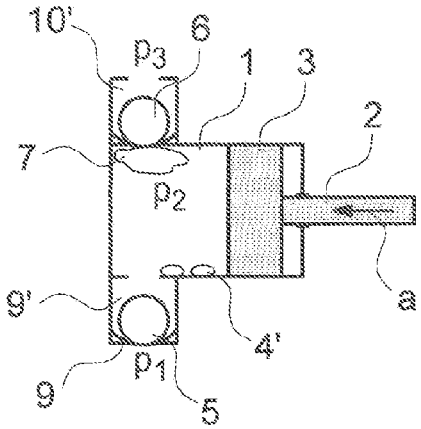
Fig.1.6
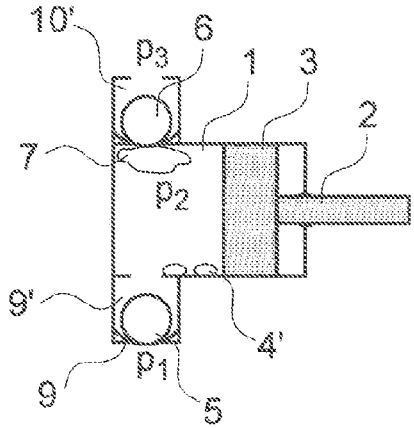
Fig.1.7
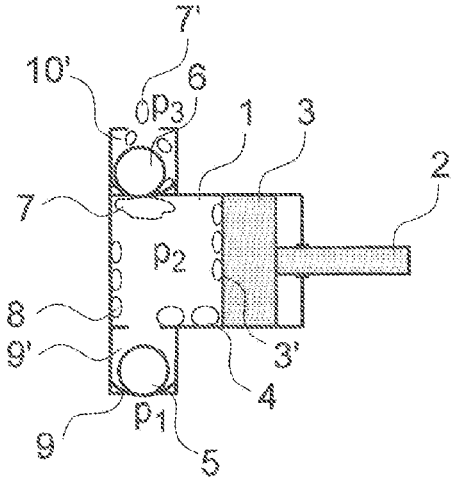
Fig.1.8
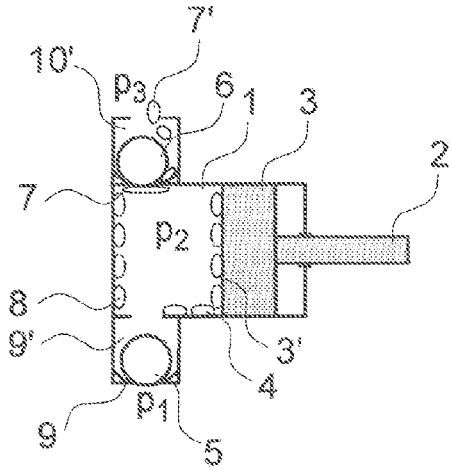

Fig.2.1
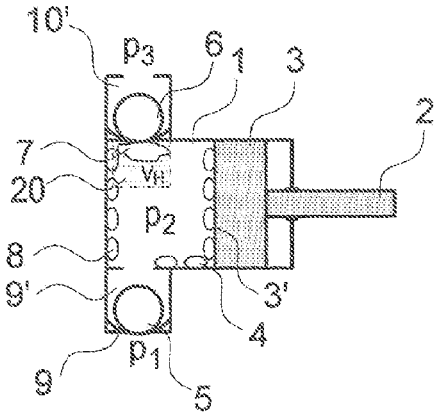
Fig.2.2
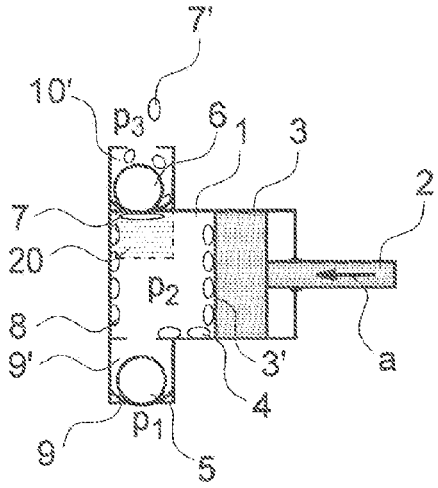
Fig.2.3
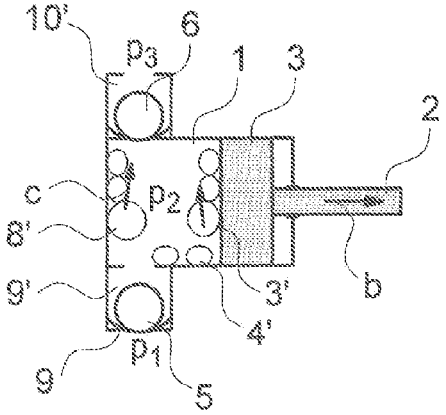
Fig.2.4
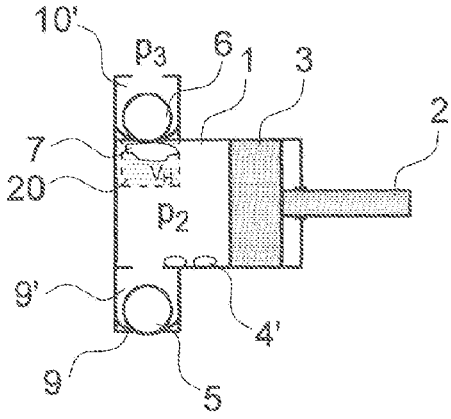

Fig.2.5
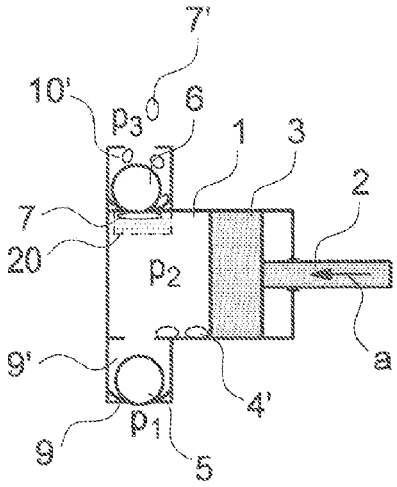
Fig.2.6
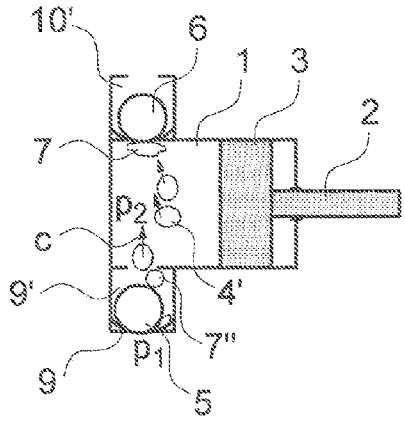
Fig.2.7
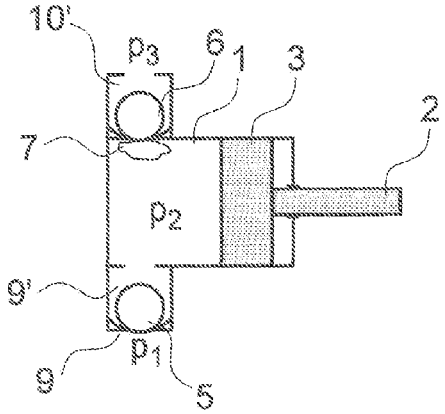
Fig.2.8
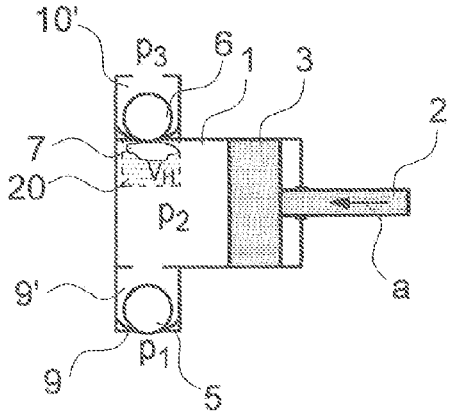

Fig.2.9
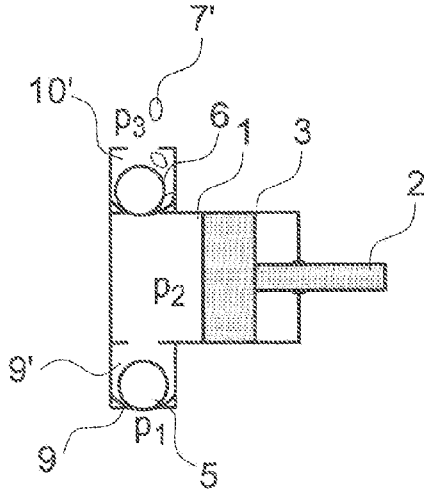
Fig.2.10
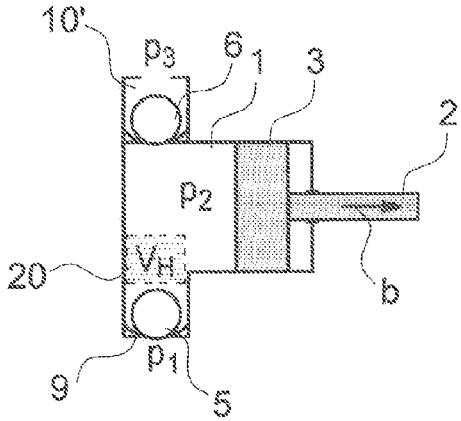

METHOD AND DEVICE FOR DEGASSING THE TRANSPORT CHAMBER OF A METERING PUMP

CROSS-REFERENCE TO RELATED APPLICATIONS

This application is a Section 371 of International Application No. PCT/EP2009/008876, filed Dec. 11, 2009, which was published in the German language on Jul. 1, 2010, under International Publication No. WO 2010/072340 A1 and the disclosure of which is incorporated herein by reference.

BACKGROUND OF THE INVENTION

The invention relates to a method for degassing a conveyor chamber of a metering pump, and a device for implementing the latter.

The problem of gas formation in conveyor chambers of metering pumps is known, in particular when metering liquids. Gas formation takes place not just during the metering processes, but also when the pump is between metering operations. In the case of degassing substances like hydrogen peroxide $H_2O_2$, gas is released, wherein the number and size of gas bubbles in the conveyor chamber grow for the time metering is suspended or during an idle period. The pressure in the metering chamber rises as a result. If the pressure in the metering chamber of the pump exceeds the pressure in the pressure line, the pressure-side pump valve opens, followed by a transfer of liquid from the metering chamber of the metering pump into the pressure line, bringing about a pressure compensation. Therefore, the ratio between the gas volume and liquid volume in the metering chamber of the pump increases, so that metering volumes are not immediately output when starting up the metering pump. The metering process is thus suspended.

This being the case, it is desirable to provide a method for actuating metering pumps that improves the startup properties, along with corresponding metering pumps suitable for this purpose.

BRIEF SUMMARY OF THE INVENTION

Taking this prior art as the basis, the object of the present invention is to create an improved method for degassing a conveyor chamber, and a corresponding device for implementing the method. These objects are achieved by a method for degassing a conveyor chamber of a metering pump, characterized by the execution of a pulse emitting process, wherein gas bubbles in the conveyor chamber generated by a gas-forming fluid that adhere to the inner surfaces are detached from these surfaces, wherein the gas bubbles present in the conveyor chamber combine to form an accumulated gas bubble, and wherein a pressure increase causes the accumulated gas bubble to escape from the conveyor chamber. The objects are further achieved by a metering pump for metering fluids, which is suitable for implementing the method, so as to degas the conveyor chamber of the metering pump, wherein a device for executing a pulse emission process is arranged in the conveyor chamber. Further developments of the objects are disclosed in the following.

A first embodiment of the method for degassing a gas-forming fluid in a conveyor chamber of a metering pump relates to a pump having a conveyor chamber into which extends a displacement body that delineates the conveyor chamber and is in tandem with a metering head, wherein the conveyor chamber exhibits two openings, of which one empties into a suction line by way of an upstroke valve, and a second empties into a pressure line by way of a pressure valve. Since the pressure in the conveyor chamber rises continuously when the pump is shut down owing to gas formation out of the fluid, the pressure valve opens when a specific value has been exceeded, so that undefined gas and fluid quantities pass into the pressure line. To prevent a percentage of fluid from passing into the pressure line at the same time that the generated gas is escaping, the method according to the invention advantageously provides that an accumulated gas bubble is present on the conveyor chamber side of the pressure valve, so that only gas escapes into the pressure line if the opening pressure of the pressure valve is exceeded.

To this end, the method provides that a pulse is emitted, wherein the pulse causes the gas bubbles generated by the gas-forming fluid in the conveyor chamber, which adhere to the inner surfaces of the conveyor chamber, to be detached from these surfaces. For this purpose, the pulse emission step involves pulsing at least one portion of the surfaces or walls bordering the conveyor chamber and/or the fluid located in the conveyor chamber. After the gas bubbles have been detached from the inner surfaces, they float in the conveyor chamber and are able to accumulate into larger gas bubbles, which then preferably rise in the direction of the pressure valve, so as to there preferably form an accumulated gas bubble on the conveyor chamber side. If the pressure in the conveyor chamber now increases, the accumulated gas exhaust bubble preferably present at the pressure valve exits the conveyor chamber into the pressure line in the form of gas bubbles. This pressure increase can be the result of even more gas being formed out of the fluid when the pump is idle for a prolonged time, wherein a partial pressure stroke of the displacement body can alternatively be performed as well to increase pressure, so that the accumulated gas bubble escapes into the pressure line. Only little if any fluid is released into the pressure line. This pulsing process advantageously ensures that the percentage of gas in the conveyor chamber of the metering pump does not exceed the level that would cause the pump to fail.

In another embodiment, the pulse for detaching the gas bubbles is produced via the generation of oscillating vibrations with a vibration generator, which is arranged in the conveyor chamber. It is here possible to impart vibration to the displacement body and/or other parts of the conveyor chamber. As an alternative, the pulse can consist of at least a partial pressure and/or partial induction stroke of the displacement body, e.g., which advantageously only aspirates such a small, if necessary infinitesimal volume that a partial induction stroke can sooner be regarded as an induction pulse. As a result, the gas bubbles adhering to the inner surfaces of the conveyor chamber are detached, and can accumulate with other gas bubbles present in the conveyor chamber.

Yet another embodiment of the method encompasses the execution of a partial stroke sequence. This partial stroke sequence can be a partial stroke sequence of induction strokes and/or pressure strokes. Successive partial pressure strokes can preferably alternate with partial induction strokes. The respective stroke length with which the displacement body is moved in the conveyor chamber can here grow, so that each ensuing partial pressure and partial induction stroke combination exhibits a greater stroke length than the one executed previously. As a consequence, the accumulated gas bubble present at the pressure valve is passed to the pressure line, and also fed to the gas bubbles adhering to the inner surfaces as a function of the growing stroke length, which in turn again form an accumulated gas bubble that is passed into the pressure line once more with the ensuing partial pressure stroke.

The increase in stroke length advantageously makes it possible to here pass the gas bubbles arising in the suction line during an induction stroke into the conveyor chamber, where they then combine to form an accumulated gas bubble, and are transferred to the pressure line by an ensuing pressure stroke. Executing this partial stroke sequence with growing stroke lengths makes it possible to almost completely degas the conveyor chamber of the metering pump, so that given a first complete stroke, which represents a metering stroke, only liquid is advantageously passed into the pressure line, as a result of which a controlled metering takes place. The number of partial strokes can here be predetermined, so that the partial stroke sequence is set beforehand with the growing stroke lengths.

As an alternative, the partial stroke sequence can be defined by way of a desired degassing level, which can be determined by detecting a pressure gradient in the conveyor chamber when executing a pressure or induction stroke. This determined pressure gradient is compared with a pressure slope value, which was ascertained as the calibration pressure gradient for a degassed conveyor chamber. The desired degassing level can here correspond to a pressure slope corresponding to the calibration pressure gradient minus a tolerance, e.g., 5%, of the calibration pressure slope value.

Executing the partial stroke sequence with growing stroke lengths enables a targeted and successive degassing of the conveyor chamber of the pump, and hence partially of the induction line(s), if gas has formed during non-operation or down times. Already before a first complete metering stroke is performed, this makes it possible to ensure that the pump does not fail in an extreme case due to the compressibility of the formed gas bubbles, or that in the best-case scenario, the conveyor system of the pump contains no gas bubbles that impair and distort the conveying rate.

A partial induction stroke according to the above description preferably has a percentage of 0.1% to 99%, preferably 1% to 50%, most preferably 1% to 25% of a complete induction stroke. Accordingly, a partial pressure stroke according to the above description preferably has a percentage of 0.1% to 99%, preferably 1% to 50%, most preferably 1% to 25% of a complete pressure stroke of the metering pump. The pressure stroke is here preferably executed by moving the displacement body, for example a piston or a diaphragm.

Additional embodiments of the method relate to the fact that intervals or points in time operationally linked with the pump can be preset, for example for known pump downtimes, so that an automatic degassing process is executed before the pump is put into operation again. The pulse is preferably emitted for degassing the conveyor chamber during a downtime or with the pump stopped. A partial stroke sequence with growing stroke lengths is preferably executed for starting up the pump after the pump has stood idle for a time.

In order to check whether gas has formed, or check the formed quantity of gas in the system, the pressure progression over a stroke can be logged in another procedural step by means a pressure sensor arranged on the conveyor chamber, which records the pressure in the conveyor chamber. If the pressure progression determined over the duration of a stroke is placed in relation to the stroke path, or to a volume limited in the conveyor chamber by the traversed stroke length of the displacement body, and graphed as a p/V diagram as needed, the result for the pressure curve during a pressure stroke is a progression that illustrates the pressure slope pattern. If the pump is in a vented state, the slope of the nearly linear pressure rise or pressure drop reaches a maximum value, which is taken as the desired value for the pressure slope pattern. If gas bubbles are present in the conveyor chamber, the pressure diagram exhibits a rise or drop with a small slope during the execution of a pressure or induction stroke, which corresponds to an actual value for the pressure gradient. As a result, the method for venting the pump can be implemented by comparing the actual value with the desired value for as long as it takes to achieve the best possible venting of the conveyor chamber. Such a comparison is performed in an evaluator, and the ascertained result is provided as a control parameter in a controller for actuating the pump. As a consequence, degassing can be initiated or the degassing duration or efficiency can be determined in a targeted manner, depending on the gas volume that comes about. The comparison results are relayed to a controller for actuating the pump, preferably as control parameters for starting up the pump with the pump standing idle, when the pump is stopping, after the pump has stopped, or for starting up the pump after the pump has stood idle for a time.

The actually conveyed volume flow in the pressure line during a stroke of the displacement body depends on the magnitude of the overall gas volume. The real, i.e., actual, conveying pattern of the pump is determined, and can be compared with a desired conveying pattern of the pump, so that a certain tolerance can be considered to assess whether the pump is still functional for the metering operation.

The invention further relates to a metering pump for metering fluids, which is suitable for implementing a method according to the above description, so as to degas the conveyor chamber of the metering pump. The conveyor chamber of the pump is preferably fluidically connected with at least one suction line that can be opened via an upstroke valve and at least one pressure line that can be opened via a pressure valve. Further, a displacement body is preferably furnished in the conveyor chamber in a known manner for displacing the fluid, or the conveyor chamber is bordered on at least one side by this displacement body, for example a piston or diaphragm. In addition, the conveyor chamber incorporates a device for executing a pulse emission process. This can be a vibration exciter, which is linked, for example, with the displacement body or a wall of the conveyor chamber, in order to impart vibrations or pulses to the fluid in the conveyor chamber. As an alternative, the drive of the displacement body itself can serve as a device for executing a pulse emission process. To this end, the drive and/or its controller or regulator are preferably equipped in such a way that the drive can control the displacement body, so that it cannot perform any induction and/or pressure strokes that only impart a pulse to the fluid in the conveyor chamber required to detach and accumulate gas bubbles in the conveyor chamber. The stroke is here preferably so small as to convey essentially no fluid. It is further preferred that the drive of the displacement body then is configured in such a way that it can force an accumulated gas bubble of the kind described above out of the conveyor chamber. This driving of the displacement body can take place mechanically, hydraulically, pneumatically and/or magnetically. For example, a stepping motor can drive the displacement body via a corresponding gear unit.

One embodiment of the pump according to the invention that can be used to implement the disclosed method relates to actuating the displacement body that displaces the fluid out of the conveyor chamber by a rotational angle- or path-controlled driving device, especially a stepping or linear motor, so as to ensure that the required partial induction strokes or partial pressure strokes are correspondingly small induction or pressure strokes, and can hence generate a correspondingly small low or excess pressure. In so doing, it is advantageously achieved that the displacement body, which can be a diaphragm or piston, traverses stroke distances measuring tenths of a millimeter. This enables the finest pressure pulses, which allow the detachment of gas bubbles adhering to the inner surfaces of the conveyor chamber, as well as to a diaphragm or a surface of the displacement piston facing into the conveyor chamber.

The diaphragm here performs a vibrating motion, which resembles a "ventricular fibrillation," i.e., there is very little or no pumping action for the fluid, but the gas bubbles are set in motion, detach from the walls and combine into larger gas bubbles, which then are exposed to a buoyant force in the fluid, and rise.

These and other advantages may be gleaned from the following description and accompanying figures.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIGS. 1.1 to 1.8 are illustrations of the chronological sequence of the degassing processes and states in the conveyor chamber of the diaphragm pump during an interruption of operation, according to an embodiment of the present invention;

FIGS. 2.1 to 2.10 are illustrations of the chronological sequence of the degassing processes and states in the conveyor chamber of the diaphragm pump during the method for establishing an operational state of the metering pump after an interruption of operation, according to an embodiment of the present invention.

DETAILED DESCRIPTION OF THE INVENTION

Figure 3:
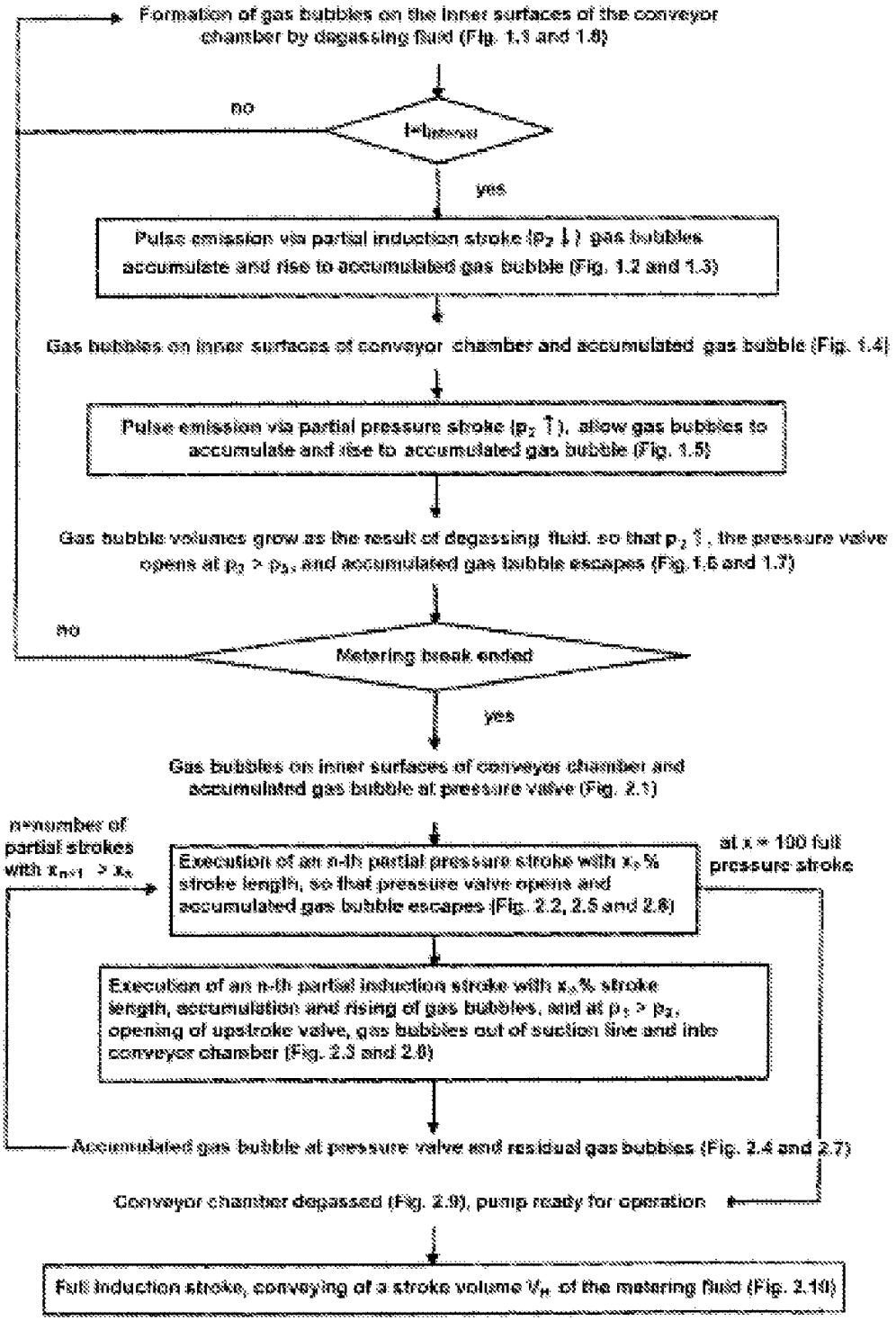
FIG. 3 is a flowchart for the method and processes during an interruption of operation, and for establishing an operational state of the metering pump, according to an embodiment of the present invention.

To better understand the subject matter, several of the terms used in the description will be defined below.

A linear motor is understood as an electric driving machine, which imparts not a rotating, but rather a translatory motion to the objects connected with it. If a linear motor is coupled in a displacement pump for actuating a piston, the piston can traverse a very short path. As a result, the piston stroke can be metered very finely. The same holds true for a stepping motor, the rotor of which only moves forward with a tiny angular displacement during each step prescribed from without. This makes it possible to achieve the highest physical positioning accuracies, and hence the finest metering strokes, if such a stepping motor is, for example, coupled by way of a cam with a connecting rod or plunger.

The chamber in the metering pump containing the fluid to be conveyed is referred to as the conveyor chamber or metering chamber; a displacement device is introduced into it for purposes of fluid displacement.

Gas-forming fluids are understood, in particular, as fluid chemicals that exhibit a tendency toward establishing equilibrium with their decomposition products, and hence eliminate gaseous products. One example of this is hydrogen peroxide. A plurality of other chemicals also tends toward gas separation, for example sodium hypochlorite bleach.

The formed gases increase the pressure in the conveyor chamber, as a result of which a conveyor chamber of a metering pump closed relative to the suction and pressure line by pressure valves, is exposed to pressure by the formation of gases. As soon as the pressure provided by the arising gases exceeds the holding pressure of the pressure valves, the pressure valve opens, and gas and fluid alike can pass into the pressure line.

The term "partial induction stroke" or "partial pressure stroke" refers to a portion of a full induction stroke/pressure stroke, wherein a full stroke is achieved when the displacement device is actuated over the entire stroke length. For example, if a displacement piston is to displace a volume of 100 ml under a one hundred percent load, a partial induction stroke comprising only a percentage of 0.1% would displace only 0.1 ml of volume. A partial induction stroke can be so small as to even perform just an oscillation of the piston, or of the diaphragm given a diaphragm pump, preferably in a range of 1 to 20 Hz, for example 2 to 10 Hz, more preferably 3 to 4 Hz, wherein no fluid is essentially conveyed in the process.

The term "stroke length" is here also used relative to the displaced volume in a way equivalent to the terms partial induction stroke, or partial pressure stroke; this is because the percentage of a partial stroke length in relation to an overall stroke length corresponds to the percentage of a partial stroke volume in relation to the overall stroke volume, so that the partial stroke length measures 25% of the overall stroke length given a partial stroke comprising 25% of a full stroke.

Also used below is the term "desired degassing level," which must be understood to mean that, depending on the fluid to be metered, a minimum degassing to be experimentally determined can be achieved. This minimum degassing would correspond to a degassing level of 1. In chemicals that permanently release gases, gases will also come about during the metering process itself, so that an ideal degassing level of such a chemical will correspond to an ideal degassing level other than the one present for a fluid that only releases gases very gradually, and for which a degassing level of close to 1 can actually be achieved. The degassing level can be determined using the flow measuring process described in German Laid-Open Patent Specification DE 35 46 189 A1, or, as described above, it can record the pressure gradient via a pressure sensor arranged in the conveyor chamber during a stroke of the displacement body, after which this actual value can be compared with the desired value.

The method according to the invention relates to the fact that a pulse can be emitted during a downtime or after the pump has stopped, whereas a partial stroke sequence with growing stroke lengths of the displacement body can be executed to commission or start up the pump after the pump has stood idle for a time.

An idle time for a pump is understood below as a period sufficient for providing a corresponding gas volume. An idle time will basically measure at least 30 minutes, and the idle time is also understood as being when the pump has not been operated overnight for more than 12 hours, or also when the pump has not been operated for several days with fluid stored inside the pump. A pump stoppage can last from several seconds up to 30 minutes. In order for the pump to implement the method according to the invention for degassing during an idle time or stoppage, the pump has to be "active," i.e., it must be supplied with power, and a degassing mode, i.e., a corresponding program in the pump software, must be activated.

The gas-forming, fluid-conveying metering pump, the conveyor chamber of which is to be liberated of the formed gas, has an upstroke valve emptying in the conveyor chamber, which extends into a suction line. Further, the conveyor chamber empties into a pressure line via a pressure valve. Much the same holds true when several pressure or suction lines are present. A displacement body for displacing the fluid borders the conveyor chamber, usually on one side, and is arranged in such a way that it can alternately execute the pressure stroke necessary for displacement in combination with the corresponding induction strokes.

In order to detach the gas bubbles caused by the gas-forming fluid and adhering to the inner surfaces bordering the conveyor chamber from these surfaces, a pulse emission process is first performed, wherein the pulses can be emitted through vibrating oscillations by a vibration generator situated in or on the conveyor chamber, or alternatively take the form of a first partial induction stroke of the displacement body, for example. This partial induction stroke corresponds to a percentage of 0.1 to 99% of a full induction stroke, and can also involve an oscillation within a range of 1 to 20 Hz. If the gas bubbles have been detached from the inner surface bordering the conveyor chamber as the result of the vibrating oscillations or, for example, the provided induction pulse, they will accumulate in the conveyor chamber and, since they have grown in volume, and resultantly experience a greater buoyant lift, will move in the direction of the pressure valve, provided that the pressure valve is situated facing upward, against the force of gravity.

An accumulated gas bubble to be discharged into the valve chamber via the pressure valve now forms on the conveyor chamber side of the pressure valve. This takes place by way of a pressure rise in the conveyor chamber, which is caused by additional gas formed by the fluid and/or by a partial pressure stroke, which can correspond to a percentage of 0.1 to 99% of a full pressure stroke. The accumulated gas bubble is compressed as a result, and itself exerts pressure on the pressure valve. When the opening pressure is exceeded, the latter opens, and the gas comprising the accumulated gas bubble will pass into the pressure line as exhaust gas bubbles. It is here advantageous for no fluid to be concurrently transported in the pressure line.

A partial induction stroke can comprise 0.1% to 99%, preferably 1% to 50%, most preferably 1% to 25% of a full induction stroke. A partial induction stroke can also be divided into a plurality of oscillating strokes, which together make up 0.1 to 10% of a full induction stroke. A partial pressure stroke can correspond to 0.1% to 99%, preferably 1% to 50%, most preferably 1% to 25% of a full pressure stroke.

In order to bring the metering pump into an operational state, the emission of pulses as described above is followed during an interruption of operation by a partial stroke sequence with growing stroke lengths of the displacement body, wherein the partial strokes range between 0.1 and 99% of a full stroke. The increasing pressure in the conveyor chamber due to the growing pressure strokes causes an accumulated gas bubble to escape from the pressure valve during the partial pressure stokes, while the increasing induction strokes can also move the gas bubbles present in the suction line into the conveyor chamber, where they move in the direction of the pressure valve, forming an accumulated gas bubble that is transferred into the pressure line with the next pressure stroke. The partial stroke sequence with growing stroke lengths is executed for as long as it takes to achieve an optimal degassing level, which is either predetermined by the number of partial strokes, or controlled by ascertaining the degassing level.

The degassing level is ascertained by detecting a pressure gradient in the conveyor chamber during the execution of a pressure or induction stroke, and comparing the ascertained pressure gradient with a pressure gradient serving as a calibration pressure gradient determined for a degassed fluid, wherein the desired degassing level here corresponds to a pressure gradient equal to the calibration pressure gradient minus a tolerance of about 5% of the calibration pressure slope value.

The values obtained from determining an actual pressure gradient during a stroke of the displacement body and the values from a comparison of the actual pressure slope pattern for the pump to a desired pressure slope pattern for the pump can be relayed to an evaluator in order to evaluate the comparison results, and sent on to a controller as a control parameter for actuating the pump.

The method can further encompass presetting intervals and points in time for a timer operationally linked with the pump, so that the pump can be subjected to time-controlled actuation for startup purposes, during a downtime, after a pump stoppage, or for pump startup after the pump has stood idle for a time. As a result, an already operational pump can advantageously be made available once metering operations have been resumed after a break or nighttime shutdown period.

Finally, the method also provides that additional control parameters be made available for starting up the pump when the pump is idle, after a pump stoppage, or for starting up the pump after an idle period: This case involves determining an actually conveyed volume flow in the pressure line during a defined stroke of the displacement body, and comparing the actual conveying pattern of the pump obtained using this defined stroke with a conveying pattern of the pump given an identically defined stroke, wherein contrasting the actual conveying pattern and desired conveying pattern of the pump shows whether gas is present in the conveyor system or not. By knowing the false conveyed volume, the controller can set in motion a corresponding degassing process, which can involve the execution of the partial stroke sequence with growing stroke lengths.

The metering pump of the method according to the invention will advantageously be a diaphragm pump. Of course, the method according to the invention can also be implemented with a piston pump. Any displacement body can be used, provided it can be induced to perform the smallest stroke motions, for example via coupling with a rise bar, compressed air or another suitable device. In order to advantageously perform small stroke motions with a diaphragm pump, a path-controlled driving device like a linear motor or stepping motor can be operatively linked with the displacement body. An EC motor may also be used. A coupling by way of a compressed air transducer is also possible.

The sequence of FIGS. 1.1 to 1.8 is based on the following initial situation: When the pump has stopped or is standing idle, various gas bubbles 4, 7, 8 are formed out of the degassing fluid in the conveyor chamber 1. Predominantly gas bubbles 4, 8 come about on the inner walls of the conveyor chamber, as well as on the piston surface 3' of the piston 3 bordering the conveyor chamber 1. This growth in gas bubbles causes the pressure $p_2$ in the conveyor chamber 1 to rise. If the pressure $p_2$ becomes greater than the pressure in the pressure line $p_3$, the pressure valve 6 opens. The pressure in the pressure line is equalized by the fluid or accumulated gas bubble 7 (depending what is present at the pressure valve) migrating from the conveyor chamber 1 into the pressure line.

It is here disadvantageous if the fluid migrates into the pressure line. This is because the ratio of gas bubbles to fluid in the conveyor chamber 1 increases in the process. If the product of the gas bubble volume and pressure in the conveyor chamber 1 becomes so great that even a full induction stroke is not enough to achieve the necessary pressure $p_2$ for opening the upstroke valve 5, which must be less than the pressure $p_1$ in the suction line, then no fluid volume will continue flowing from the suction line into the conveyor chamber 1. This in turn means that a full induction stroke causes the pressure $p_2$ of the fluid volume in the conveyor chamber 1 to increase at most to a pressure corresponding to the pressure $p_3$ in the pressure line, so that pressure valve 6 also does not open. Only the gas bubbles 4, 7, 8 trapped in the conveyor chamber 1 are compressed and again expanded, without the pump conveying volumes out of the suction line into the pressure line. Therefore, a metering process is not possible.

In order to prevent this, only a small percentage of the fluid is to pass from the conveyor chamber 1 into the pressure line with the pump stopped or during an idle period as the gas bubbles grow in the conveyor chamber 1, and the gas bubble percentage is not to increase to a point where the metering process fails. To this end, pulses are emitted during an interruption in pump operation to detach the gas bubbles 4, 8 from the inner walls of the conveyor chamber 1. As a result, the smaller gas bubbles combine to form a large accumulated gas bubble 7, which rises up until reaching the pressure valve 6 in response to the buoyant force. This pulse can be achieved via the movement of the piston 3, as diagrammatically shown in FIG. sequence 1.1 to 1.8.

FIGS. 1.1 to 1.8 depict how the pump, which here is a diaphragm pump, is kept operational, even though the diaphragm itself is not figuratively shown separately. The gas bubbles can be created via the breakdown of instable fluids, such as hydrogen peroxide ($H_2O_2$). A pulse emission takes the form of a partial induction stroke b and partial pressure stroke a, and the pulse can alternatively also be generated by an oscillation of the diaphragm.

In FIG. 1.1, the gas bubbles 4, 7, 8 grow in the conveyor chamber 1 during an interruption in pump operation, and the pressure $p_2$ rises as the percentage of gas bubbles increases.

As a result of an induction stroke b of the piston 3 of the kind shown in FIG. 1.2, the volume trapped in the conveyor chamber 1 increases, and the pressure $p_2$ in the conveyor chamber 1 decreases, causing the gas bubbles 4', 7, 8' to take up larger volumes according to equation (I):

$$p_{before} \times V_{before}^{n} = p_{after} \times V_{after}^{n} \quad \text{(I)}$$

FIG. 1.3 is a sketch depicting how a continued induction stroke b of the piston 3 causes the gas bubbles 4', 7, 8' to become even larger, accumulate and rise in the direction of the pressure valve 6. The upstroke valve 5 can here continue to remain closed.

FIG. 1.4 shows a large accumulated gas bubble 7 after the induction stroke of the piston 3 has ended. The gas bubbles 8' enlarged beforehand and detached from the inner wall of the conveyor chamber 1 as depicted in FIG. 1.3 have combined to form this accumulated gas bubble 7, which is now present at the pressure valve 6; several gas bubbles 4' continue to be suspended from the inner walls of the conveyor chamber 1.

An ensuing pressure stroke a of the piston 3, as depicted in FIG. 1.5, prompts the pressure $p_2$ in the conveyor chamber 1 to rise again, causing the volume trapped in the conveyor chamber 1 to decrease. As a consequence, the volume of the gas bubbles 4' present in the conveyor chamber 1 and the accumulated gas bubble 7 correspondingly becomes smaller according to equation (I).

After the pressure stroke a of the piston 3 has ended, as depicted in FIG. 1.6, a position of the piston 3 of the kind shown in FIG. 1.1 is achieved. In this case, the pressure level $p_2$ in the conveyor chamber 1 also corresponds to the pressure level from FIG. 1.1. As opposed to the situation in FIG. 1.1, only a few gas bubbles 4' on the inner walls of the conveyor chamber along with the accumulated gas bubble 7 are still in evidence in FIG. 1.6, which are present at the pressure valve 6.

FIG. 1.7 shows how a continued degassing of the fluid causes the volume of gas bubbles 4, 8 and the accumulated gas bubble 7 to grow, and the pressure $p_2$ in the conveyor chamber 1 to rise further. This pressure rise causes the pressure $p_2$ in the conveyor chamber 1 to become higher than in the pressure line ($p_2 > p_3$). As a result, the pressure valve 6 opens, and the accumulated gas bubble 7 adjoining it begins to escape in the form of outlet gas bubbles 7' due to the pressure equalization in the pressure line.

Continued degassing of the fluid in the conveyor chamber 1 causes additional outlet gas bubbles 7' of the accumulated gas bubble 7 to be conveyed into the pressure line, as shown in FIG. 1.8. In other words, the degassing fluid in the conveyor chamber 1 keeps displacing the accumulated gas bubble 7 in the form of outlet gas bubbles 7' out of the conveyor chamber 1 into the pressure line for as long as the pressure $p_2$ in the conveyor chamber 1 exceeds the pressure $p_3$ in the pressure line. In order to prevent the growing gas bubbles 4, 8 from displacing fluid from the conveyor chamber 1 into the pressure line, an induction stroke b is again initiated to form an accumulated gas bubble 7 at the pressure valve 6, as depicted in FIG. 1.2.

The fine induction strokes and pressure strokes can be readily performed with a metering pump for metering fluids, if the displacement body of the device is operated by a stepping or linear motor and acts on the diaphragm or piston as a displacement body, or if a vibration generator is installed for generating pulses.

The displacement body, which can be a piston or a flexible diaphragm 3, can be driven mechanically by a rise bar 2, or hydraulically or pneumatically or magnetically.

This conveyor chamber degassing method can be implemented repeatedly during an idle period, for example when a timing device (not shown) outputs a signal at predetermined intervals of time or predetermined points in time that initiates the method for degassing the conveyor chamber. Empirical values can here be drawn upon, allowing the expert to set the time intervals in such a way that the conveyor chamber degassing takes place when a correspondingly strong gas bubble formation is to be expected.

On the other hand, an evaluator for evaluating the comparison results can be used to execute a step for determining an actual pressure gradient in the conveyor chamber during a pressure or induction stroke, and comparing the actual pressure slope pattern of the pump with a desired pressure slope pattern of the pump, wherein the comparison results are exported to a controller for actuating the pump as control parameters for starting up the pump after the pump has been idle for a time, or alternatively after a pump stoppage. The steps of setting a timer or a controller based on the determination of the pressure rise pressure gradient in the conveyor chamber during a pressure or induction stroke can be performed at any desired points in time, and even alternately actuated, if necessary switching with a manual implementation of the method.

The pressure gradient can be determined with a pressure measuring device present in the conveyor chamber, which records the pressure progression $p_2$ in the conveyor chamber over a pressure or induction stroke, wherein the slope of the pressure rise or pressure drop tapers off in a plotted pressure/stroke length diagram as gas bubble formation increases, since the gas bubbles are compressible, and the conveyor chamber venting is automatically initiated if a value drops below a specific threshold, while the data are coupled back to a controller.

The method according to the invention further relates to establishing an operational state of the pump by removing gas bubbles from the conveyor chamber and feed lines, such as the suction line, as quickly as possible with the simplest means, so that the pump can do its job of precise metering, without a plurality of imprecise metering strokes taking place once metering has been resumed after a pause.

The FIG. sequence 2.1 to 2.10 is hence based upon the following initial situation: The pump is to again start metering after an interruption in operation. A complete pressure stroke can here not be executed immediately as the metering fluids are degassing, meaning that the displacement body must not complete a full stroke volume.

In the following, reference is made to FIG. sequence 2.1 to 2.10 to describe the processes in which gas bubbles 4, 4', 7, 8, 8' are transferred by growing partial strokes a and b from the conveyor chamber 1 into the pressure line, so that only a small percentage of the fluid passes from the conveyor chamber 1 into the pressure line before the gas bubbles 4, 4', 7, 8, 8' are removed from the conveyor chamber 1. To this end, the percentage of gas bubbles in the conveyor chamber 1 is reduced through partial strokes with growing stroke length in such a way that the metering process can take place.

As depicted in FIG. 2.1, gas bubbles were created in the conveyor chamber 1, comprised both of an accumulated bubble 7 and gas bubbles 4, 8 on the inner surfaces of conveyor chamber 1. The dashed border region symbolizes the magnitude of the stroke volume $V_H$ 20.

The pressure stroke motion a of the piston 3 causes the pressure $p_2$ in the conveyor chamber 1 to rise (FIG. 2.2), wherein the volume bounded by the piston 3 in the conveyor chamber 1 drops. When the opening pressure of the pressure valve 6 ($p_2>p_3$) has been reached, a partial stroke volume $V_H$ 20 is displaced into the pressure line, primarily the accumulated gas bubble 7 present at the pressure valve 6.

After the partial pressure stroke a has ended according to FIG. 2.2, a partial induction stroke b is performed, as shown in FIG. 2.3. The suction motion of the piston 3 here lowers the pressure $p_2$ in the conveyor chamber 1. At the same time, the volume bounded by the piston 3 in the conveyor chamber 1 increases. According to the above equation (I), the gas bubbles 4', 8' take up larger volumes. Several combine to form a large accumulated gas bubble 7, which is present at the pressure valve 6, as depicted in the following FIG. 2.4.

In FIG. 2.4, the partial induction stroke b of the displacement body 3 has ended, and the piston 3 has assumed its initial position. Both an accumulated gas bubble 7 and the gas bubbles 4' are again present on the inner surfaces of the conveyor chamber 1. However, the volumetric percentage of gas bubbles 4' present on the inner surfaces of the conveyor chamber 1 is now reduced. The stroke volume $V_H$ 20 relates to the ensuing partial pressure stroke shown in FIG. 2.5.

As a result of this additional, second partial pressure stroke a of the piston 3 in FIG. 2.5, wherein the stroke length of the second pressure stroke a is greater than that of the preceding pressure stroke in FIG. 2.2, the pressure $p_2$ in the conveyor chamber 1 again starts to rise, and the volume trapped in the conveyor chamber 1 tapers off. At the latest after the stroke length of the preceding stroke has been exceeded, the opening pressure of the pressure valve 6 is reached ($p_2>p_3$), so that a partial stroke volume 20 of the fluid, but primarily the accumulated gas bubble 7 present at the pressure valve 6, is passed into the pressure line. The partial stroke volume 20 is at least as large as the stroke difference between the preceding stroke and the current, larger partial stroke.

As shown in FIG. 2.6, an additional, second partial induction stroke b is executed after the second partial pressure stroke ends. The partial induction stroke b of the piston 3 causes the pressure $p_2$ in the conveyor chamber 1 to drop, while the volume trapped in the conveyor chamber 1 according to equation (I), and hence the volumes of the gas bubbles 4', increase analogously. This causes the gas bubbles 4' to rise in the direction of the pressure valve 6. While there or rising, they combine to form a new, large accumulated gas bubble 7, which then is present at the pressure valve 6. Once the necessary pressure for opening the upstroke valve 5 has here been reached, a volume is also aspirated from the suction line. The latter can consist partially of fluid volume, and partially of gas volume. The gas bubbles 7" subsequently delivered from the suction line via the upstroke valve 5 rise in the conveyor chamber 1 in the direction of the pressure valve 6 (arrow c).

In FIG. 2.7, the second partial induction stroke of the piston 3 has ended, and the displacement body 3 again assumes the initial position. Only the accumulated gas bubble 7 present on the pressure valve 6 is now on hand.

The piston 3 compresses the volume trapped in the conveyor chamber 1 by the piston as shown in FIG. 2.8 by a third pressure stroke a, the stroke length of which is in turn greater than that of the preceding stroke, and here corresponds to a full pressure stroke. In like manner, the previously formed accumulated gas bubble 7 present at the pressure valve 6 and encompassing the entire percentage of gas in the conveyor chamber 1 is also compressed, so that it can be relayed into the pressure line with the stroke volume $V_H$ 20, as depicted in the following FIG. 2.9.

Once a full pressure stroke a has been executed, the accumulated gas bubble 7 exits the conveyor chamber 1 in the form of outlet gas bubbles 7', passing through the pressure valve 6 and into the pressure line (shown in FIG. 2.9). In an ideal case, the conveyor chamber 1 is now free of the gas bubbles adhering to the inner surfaces of the conveyor chamber 1.

As finally shown in FIG. 2.10, this full pressure stroke a, which completely degassed the conveyor chamber 1, is followed by the first full induction stroke b. The suction line here aspirates a full stroke volume $V_H$ 20 through the upstroke valve 5 and into the conveyor chamber 1.

Therefore, the pump was advantageously degassed with a small number of stroke motions, without significant quantities of metering fluid having already been pumped into the pressure line, and while there undesirably output as well during the first metering stroke. The partial induction strokes disclosed in the method according to the invention, which if necessary perform a stroke so small that it can be referred to as a vibration, along with the accompanying partial pressure strokes are sufficient for degassing the conveyor chamber and part of the suction line.

While the method for degassing the conveyor chamber of the pump to achieve an operational state can be manually initiated, its controlled regulation is also possible, so that the method according to the invention can be initiated once a control unit has signaled that metering is required when a timer provides for degassing. The parameters determined above can be relayed to a corresponding control and regulating unit operatively connected with the pump in a manner known to the expert, so as to trigger the method according to the invention starting with the desired steps.

A flowchart in FIG. 3 shows a possible chronological or logical sequence of the method according to the invention. Aside from the procedural steps, the processes ongoing in the conveyor chamber of the pump are described. Starting after a metering break of the metering pump, wherein the degassing fluid in the conveyor chamber has caused gas bubbles to form inside the conveyor chamber, which adhere to the inner surfaces of the conveyor chamber (corresponds to FIGS. 1.1 and 1.8), the pulse emission is executed after a predetermined time interval $t_{interval}$, during which the pressure $p_2$ inside the conveyor chamber drops in a first partial step as the result of a partial induction stroke, causing the volume of gas bubbles to grow, so that the gas bubbles accumulate and rise to the accumulated gas bubble (see FIGS. 1.2 and 1.3). Gas bubbles are still present on the inner surfaces of the conveyor chamber, and the accumulated gas bubble is still present on the pressure valve (see FIG. 1.4). The second partial step of the pulse emission process takes place by performing a partial pressure stroke, as a result of which the pressure $p_2$ in the conveyor chamber rises, causing a further accumulation of gas bubbles and rising to the accumulated gas bubble (see FIG. 1.5). As the idle time continues, the further degassing of the fluid causes the gas bubble volumes to grow, as a result of which the pressure $p_2$ in the conveyor chamber continues to rise, so that the accumulated gas bubble escapes when the opening pressure of the pressure valve is exceeded, when the pressure $p_2$ in the conveyor chamber becomes greater than the pressure $p_3$ in the pressure line (see FIGS. 1.6 and 1.7). If the metering break of the pump persists, the pulse emission via partial induction stroke and partial pressure stroke is continued spaced apart by the preset time interval $t_{interval}$ until the metering break has ended.

After the metering break has ended, the conveyor chamber hence still incorporates gas bubbles on the inner surfaces of the conveyor chamber, and an accumulated gas bubble is present on the pressure valve (see FIG. 2.1). In order to bring the metering pump to a metering-ready state, the partial stroke sequence is now executed with growing stroke lengths of the displacement body, wherein the partial stroke sequence consists of n partial stroke combinations of partial pressure strokes and partial induction strokes. The number n of partial stroke combinations can be preset or controlled as a function of the degassing state of the conveyor chamber. Each partial pressure stroke/partial induction stroke combination is executed with a stroke length corresponding to a percentage equal to $x_n$ % of a full stroke length, wherein each ensuing partial pressure stroke/partial induction stroke combination exhibits a larger stroke length ($x_{n+1}>x_n$). After a first partial pressure stroke with a first stroke length equal to $x_1$% of a full stroke length has been performed, during which the pressure valve opens and the accumulated gas bubble escapes (see FIG. 2.2), a first partial induction stroke with the first stroke length is executed, causing gas bubbles to accumulate and rise (see FIG. 2.3). After the first partial pressure stroke/partial induction stroke combination, the accumulated gas bubbles are still present at the pressure valve, and the residual gas bubbles are present in the conveyor chamber (see FIG. 2.4).

In a second partial stroke combination with a second stroke length equal to $x_2$% of a full stroke length greater than the first stroke length, the second partial pressure stroke is performed as depicted by the state in FIG. 2.5, while executing a second partial induction stroke with the second stroke length (see FIG. 2.6) additionally resulting in a situation where gas bubbles can be subsequently delivered from the suction line into the conveyor chamber, if the pressure $p_2$ in the conveyor chamber becomes smaller than the pressure $p_1$ in the suction line, so that the upstroke valve opens.

After the second partial stroke combination has been performed, another accumulated gas bubble finally is present at the pressure valve (see FIG. 2.7), which then is removed by performing a third pressure stroke, which here is a full pressure stroke with $x_3$=100% stroke length. The pressure valve here opens, and the accumulated gas bubble escapes (see FIG. 2.8), and the conveyor chamber is now in a degassed state (FIG. 2.9), and the pump is operational as a result.

The pump can now convey an entire stroke volume $V_H$ by performing a full induction stroke (see FIG. 2.10).

In the present case, the method according to FIG. 3 was described with drawing reference to the FIGS. sequence 2.1-2.10 by executing the partial stroke sequence with growing stroke lengths with the number of partial strokes totaling three. However, the number of partial strokes in the partial stroke sequence with growing stroke lengths is not limited, and can be adjusted depending on the existing conditions relative to the conveyor chamber and the fluid to be metered. As mentioned above, the number of partial strokes in the partial stroke sequence can also be controlled with the help of a suitable measuring technique, depending on whether the gas bubbles are present in the conveyor chamber.

This measuring technique can be used to determine whether gas bubbles are still present or not. For example, this device can be an optical sensor or a pressure sensor. If there are no more gas bubbles present, the pump is already in an operational state; if the device for ascertaining whether gas bubbles are still present determines that gas bubbles are still present, the partial stroke sequence is initiated with growing stroke lengths, wherein partial induction strokes cause edge gas bubbles to accumulate from the conveyor chamber and rise to an accumulated gas bubble, which is passed over into the pressure line via a partial pressure stroke. This loop is continued until such time as no more gas bubbles are present, so that the pump is in an operational state, and hence can meter.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method for degassing a conveyor chamber of a metering pump, the method comprising executing a pulse emitting process comprising: detaching from inner surfaces of the conveyor chamber gas bubbles generated by a gas-forming fluid that adhere to the inner surfaces, combining the detached gas bubbles present in the conveyor chamber to form an accumulated gas bubble, and increasing pressure in the conveyor chamber to cause the accumulated gas bubble to escape from the conveyor chamber.

2. The method according to claim 1, wherein the metering pump is configured such that at least one suction line extends into the conveyor chamber via an upstroke valve, wherein a pressure line extends out of the conveyor chamber via a pressure valve, wherein a displacement body in tandem with a metering head for displacing a gas-forming fluid provides inner surfaces for bordering the conveyor chamber, wherein the pulse emitting process causes the detached gas bubbles to execute a movement toward the pressure valve to form the accumulated gas bubble on a side of the conveyor chamber at the pressure valve, and wherein the pressure increase causes the accumulated gas bubble present at the pressure valve to escape into the pressure line in a form of outlet gas bubbles.

3. The method according to claim 2, wherein the pressure increase in the conveyor chamber is caused by at least one of exit of gas from the fluid and a partial pressure stroke of the displacement body.

4. The method according to claim 2, wherein pulses of the pulse emitting process are emitted by executing at least a partial stroke or partial stroke sequence or a vibration of the displacement body, or by generating vibrating oscillations by a vibration generator.

5. The method according to claim 4, wherein by executing a partial stroke sequence with growing stroke lengths of the displacement body the accumulated gas bubble is passed into the pressure line, and gas bubbles still adhering to the inner surfaces are subsequently delivered as a function of the growing stroke length to form a new accumulated gas bubble.

6. The method according to claim 5, wherein a preset number of partial strokes determines the partial stroke sequence with growing stroke lengths.

7. The method according to claim 2, further comprising determining a desired degassing level by detecting a pressure gradient in the conveyor chamber while executing a pressure or induction stroke, and comparing a determined pressure rise with a calibration pressure gradient value determined for a degassed conveyor chamber, wherein the desired degassing level corresponds to a pressure rise equal to the calibration pressure gradient value minus a predefined tolerance of a calibration pressure gradient value.

8. The method according to claim 4, wherein a partial induction stroke corresponds to 0.1% to 99% of a full induction stroke, and a partial pressure stroke corresponds to 0.1% to 99% of a full pressure stroke.

9. The method according to claim 4, wherein a partial induction stroke corresponds to 1% to 50% of a full induction stroke, and a partial pressure stroke corresponds to 1% to 50% of a full pressure stroke.

10. The method according to claim 4, wherein a partial induction stroke corresponds to 1% to 25% of a full induction stroke, and a partial pressure stroke corresponds to 1% to 25% of a full pressure stroke.

11. The method according to claim 1, wherein the pulse emitting process is executed during an idle period or a stopped period of the metering pump.

12. The method according to claim 5, wherein the partial stroke sequence with growing stroke lengths is executed for starting up the metering pump after the metering pump has been standing idle for a time.

13. The method according to claim 5, further comprising presetting intervals of time ($t_{interval}$) or points in time for a timer operatively linked with the metering pump, such that the executing of the pulse emitting process and the partial stroke sequence with growing stroke lengths can be timed.

14. The method according to claim 7, further comprising delivering values from determining an actual pressure gradient during a stroke of the displacement body and values from comparing the actual pressure gradient of the metering pump with a desired pressure gradient behavior of the metering pump to an evaluator to evaluate the comparison results, wherein the comparison results are relayed to a controller for actuating the metering pump as a control parameter for starting up the pump during at least one of the following conditions:

with the metering pump standing idle, during a stoppage of the metering pump, after a stoppage of the metering pump, or for starting up the metering pump after the metering pump has stood idle for a time.

15. A metering pump for metering fluids, the metering pump comprising:

a conveyor chamber; and a device arranged in the conveyor chamber, wherein the device executes a pulse emitting process to degas the conveyor chamber, the pulse emitting process comprising detaching from inner surfaces of the conveyor chamber gas bubbles generated by a gas-forming fluid that adhere to the inner surfaces, combining the detached gas bubbles present in the conveyor chamber to form an accumulated gas bubble, and increasing pressure in the conveyor chamber to cause the accumulated gas bubble to escape from the conveyor chamber.

16. The metering pump according to claim 15, wherein the device for executing the pulse emitting process comprises a vibration generator arranged in or on the conveyor chamber.

17. The metering pump according to claim 15, wherein the device for executing the pulse emitting process comprises a displacement body operated by a rotational angle- or path-controlled driving device, wherein the rotational angle- or path-controlled driving device produces partial induction strokes and partial pressure strokes of the displacement body.

18. The metering pump according to claim 17, wherein the rotational angle- or path-controlled driving device is selected from a stepping motor, an EC motor or a linear motor.

19. The metering pump according to claim 17, wherein the displacement body comprises a piston or flexible diaphragm.

20. The metering pump according to claim 17, wherein the displacement body is actuated by at lest one of the following: mechanically, hydraulically, pneumatically, and magnetically.

* * * * *